US011767985B2

(12) United States Patent
Martínez García et al.

(10) Patent No.: US 11,767,985 B2
(45) Date of Patent: Sep. 26, 2023

(54) DEVICE FOR REINFORCING AND VENTILATING FURNITURE

(71) Applicant: FAMAR MUEBLES, S.L., Villamalea (ES)

(72) Inventors: Francisco José Martínez García, Villamalea (ES); Fabián Martínez García, Villamalea (ES)

(73) Assignee: FAMAR MUEBLES, S.L., Villamalea (ES)

( * ) Notice: Subject to any disclaimer, the term of this patent is extended or adjusted under 35 U.S.C. 154(b) by 0 days.

(21) Appl. No.: 17/796,261

(22) PCT Filed: Feb. 19, 2021

(86) PCT No.: PCT/ES2021/070122

§ 371 (c)(1),
(2) Date: Jul. 28, 2022

(87) PCT Pub. No.: WO2021/165563

PCT Pub. Date: Aug. 26, 2021

(65) Prior Publication Data

US 2023/0082107 A1 Mar. 16, 2023

(30) Foreign Application Priority Data

Feb. 20, 2020 (ES) ..... ES202030149

(51) Int. Cl.
*F24C 15/00* (2006.01)
*A47B 96/20* (2006.01)

(52) U.S. Cl.
CPC ..... *F24C 15/006* (2013.01); *A47B 96/201* (2013.01); *A47B 96/205* (2013.01)

(58) Field of Classification Search
CPC ..... A47B 96/201; A47B 96/205; A47B 77/08; F24C 15/006
See application file for complete search history.

(56) References Cited

U.S. PATENT DOCUMENTS 5,971,511 A * 10/1999 Diebel ..... H02B 1/38 312/265.5
6,021,909 A * 2/2000 Tang ..... H05K 7/1421 211/183

(Continued)

FOREIGN PATENT DOCUMENTS

DE 102018001777 A1 * 9/2019
EP 1726885 11/2006

(Continued)

OTHER PUBLICATIONS

International Search Report for related patent application PCT/ES2021/070122 prepared by the European Patent Office dated Jul. 2, 2021, English translation copy provided.

(Continued)

*Primary Examiner* — Matthew W Ing
(74) *Attorney, Agent, or Firm* — Hassan Abbas Shakir; Shakir Law PLLC

(57) ABSTRACT

A device for reinforcing and ventilating furniture, includes at least one first longitudinal profile that has at least one line of through holes arranged along the longitudinal dimension thereof, and at least one second longitudinal profile, the at least first profile and the at least second profile being mutually joined along the same longitudinal dimension thereof.

9 Claims, 11 Drawing Sheets

(56) References Cited

U.S. PATENT DOCUMENTS

| | | | | |
|---|---|---|---|---|
| 6,575,657 | B1 * | 6/2003 | Reuter | H02B 1/32<br>211/183 |
| 2022/0381441 | A1 * | 12/2022 | Kim | F24C 15/08 |

FOREIGN PATENT DOCUMENTS

| | | |
|---|---|---|
| KR | 20080064382 | 7/2008 |
| WO | 2008084918 | 7/2008 |

OTHER PUBLICATIONS

Written Opinion of the International Searching Authority for related patent application PCT/ES2021/070122 prepared by the European Patent Office and uploaded to WIPO Patentscope dated Aug. 26, 2021, in English.

International Preliminary Report on Patentabiliy for related patent application for PCT/ES2021/070122 prepared by the European Patent Office and dated Dec. 22, 2021.

Submission under Art. 24 made to the European Patent Office for related patent application for PCT/ES2021/070122 dated Nov. 18, 2021 by Isem Patentes y Marcas, S.L.

* cited by examiner

DEVICE FOR REINFORCING AND VENTILATING FURNITURE

CROSS-REFERENCE TO RELATED APPLICATIONS

This application is a national stage under 35 U.S.C. § 371 of PCT patent application PCT/ES2021/070122 filed on 19 Feb. 2021, which is pending and which is hereby incorporated by reference in its entirety for all purposes. PCT/ES2021/070122 claims priority to Spanish Patent Application P202030149 filed on 21 Feb. 2020, which is hereby incorporated by reference in its entirety for all purposes.

FIELD OF THE INVENTION

The present invention is directed to a device for reinforcing and ventilating furniture which incorporates significant innovations and advantages over the techniques used up until now.

More specifically, the invention proposes the development of a device for reinforcing and ventilating furniture which, due to the particular arrangement thereof, ensures that furniture, for example kitchen furniture, is adequately and simultaneously reinforced and ventilated.

BACKGROUND OF THE INVENTION

In the current state of the art, the need to ventilate furniture elements is known, especially furniture that houses cooking appliances, such as glass-ceramic hobs, ovens or induction hobs.

Therefore, with the aim of providing proper ventilation means to keep these appliances working properly, different types of ventilation grilles made of different materials and with various arrangements are also known in the state of the art, designed to connect and ventilate the interior of the furniture with the kitchen space outside the same.

Particularly noteworthy are magnetic induction hobs, which require optimal ventilation conditions to achieve proper functioning thereof, allowing the magnetic generators thereof to be cooled, and therefore heat to be generated in optimal conditions.

Furthermore, in furniture which includes both an oven and an induction or glass-ceramic hob, the need for proper ventilation increases significantly.

Ventilation grilles which provide ventilation for kitchen furniture are commonly used, however, they substantially reduce the rigidity and supporting conditions of the counter which is positioned over the same.

The present invention contributes to solving the present problem, given that it ensures that furniture, for example kitchen furniture, is adequately and simultaneously reinforced and ventilated.

DESCRIPTION OF THE INVENTION

The present invention has been developed with the aim of providing a device for reinforcing and ventilating furniture, which comprises a first longitudinal profile that has at least one line of through holes arranged along the longitudinal dimension thereof and so that the first profile (1) and the second profile (2) share their longitudinal dimension, and at least one second longitudinal profile, the at least first profile and the at least second profile being mutually joined along the same longitudinal dimension thereof.

Preferably, in the device for reinforcing and ventilating furniture, the first profile is enabled to be coupled and fastened to kitchen furniture.

Alternatively, in the device for reinforcing and ventilating furniture, the at least first profile has an inverted L-shaped section.

In another embodiment of the invention, in the device for reinforcing and ventilating furniture, the at least first profile has an inverted C-shaped section.

Alternatively, the device for reinforcing and ventilating furniture comprises mounting means enabled for linear mounting of a plurality of first profiles in continuity with the longitudinal dimension thereof, likewise including the second profile; furthermore allowing for the mounting of other embellishing profiles in series which are commonly used in the state of the art.

Additionally, in the device for reinforcing and ventilating furniture, the mounting means comprise screw elements.

Alternatively, in the device for reinforcing and ventilating furniture, the mounting means comprise pins able to be inserted by pressure into the ends of the first profile, more specifically into the cavity resulting from the joining of the at least first profile with the at least second profile.

Alternatively, the device for reinforcing and ventilating furniture incorporates separation means, enabled to be arranged inside the kitchen furniture and to create separated spaces inside the kitchen furniture itself.

Additionally, in the device for reinforcing and ventilating furniture, the separation means comprise an insulation sheet and a pair of supporting profiles, said pair of profiles enabled to be joined to the first profile along the same longitudinal dimension thereof, as well as to be supported and sustained in the furniture itself; the insulation sheet and the pair of supporting profiles being mutually enabled so that the insulation sheet is horizontally inserted into any of the edges of each supporting profile.

Preferably, in the device for reinforcing and ventilating furniture, the first longitudinal profile and the second longitudinal profile are integral.

Alternatively, in the device for reinforcing and ventilating furniture, the first longitudinal profile and the second longitudinal profile are joined by means of screw or clipping elements.

The present invention makes it so that furniture, for example kitchen furniture, is adequately and simultaneously reinforced and ventilated.

Other features and advantages of the device for reinforcing and ventilating furniture will become apparent from the description of a preferred but not exclusive embodiment illustrated by way of non-limiting example in the attached drawings, in which:

DESCRIPTION OF A PREFERRED EMBODIMENT

Figure 1:
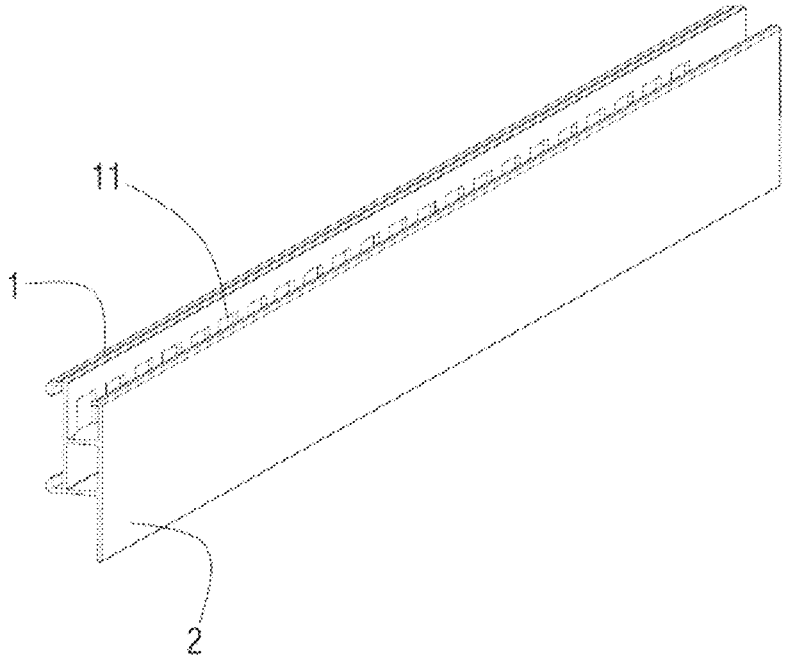
FIG. 1 is a schematic perspective view of a preferred embodiment of the device for reinforcing and ventilating furniture of the present invention.

As shown in FIG. 1, in this preferred embodiment, the device for reinforcing and ventilating furniture of the present invention comprises at least one first longitudinal profile 1 that has at least one line of through holes 11 arranged along the longitudinal dimension thereof, and at least one second longitudinal profile 2.

The first profile 1 and the second profile 2 are joined along the same longitudinal dimension thereof, being integral to one another. In other preferred embodiments, they could be joined by screw or clipping elements.

In this preferred embodiment shown, the first profile 1 has an inverted L-shaped section, as can be seen mainly in FIG. 1.

In other embodiments, the first profile 1 has an inverted C-shaped section.

Figure 2:
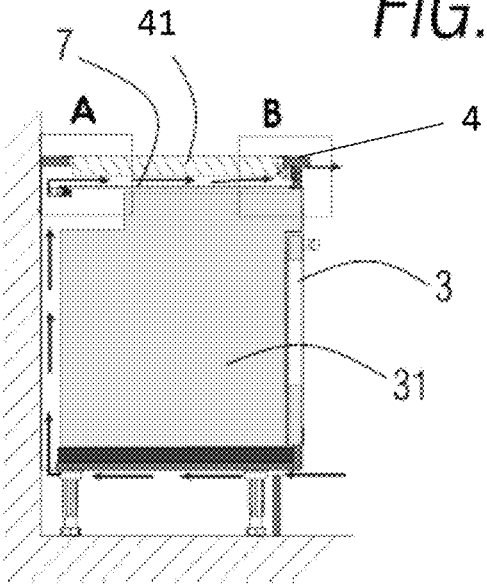
FIGS. 2, 3 and 4 are schematic views showing a preferred embodiment of the device for reinforcing and ventilating furniture of the present invention as used in kitchen furniture.
Figure 2:
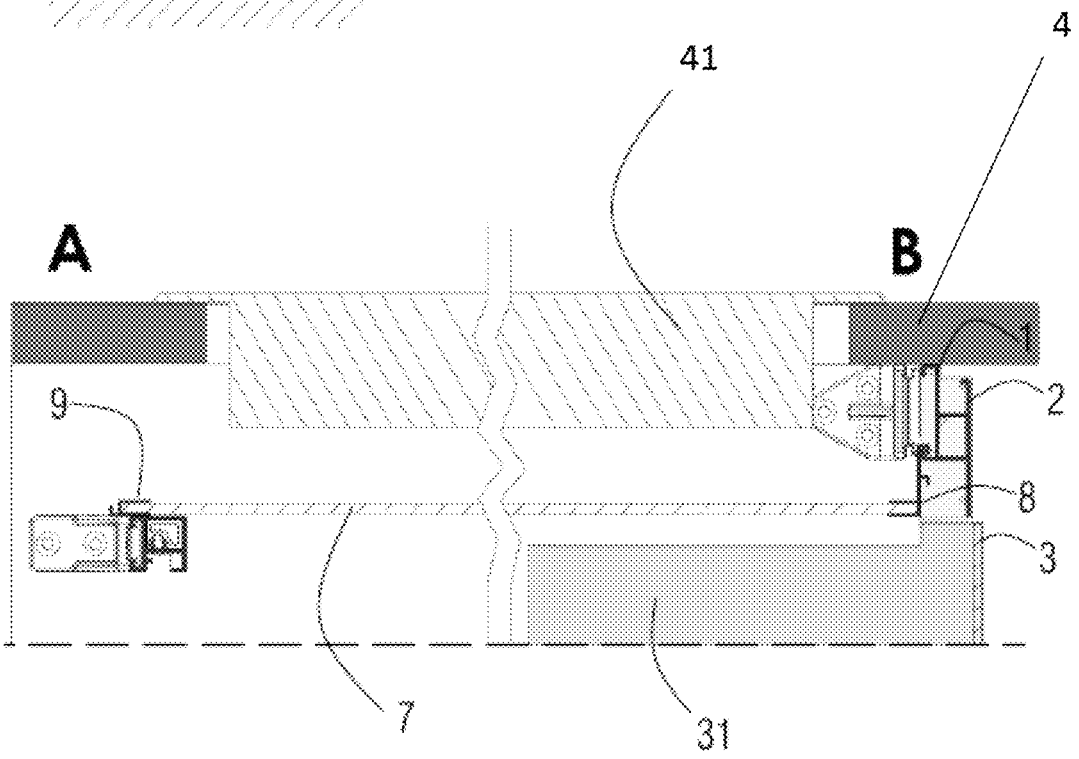

As shown in FIG. 2 and in the enlarged detailed view, the device for reinforcing and ventilating furniture of the present invention is enabled to be coupled and fastened to kitchen furniture 3, in this case to a counter 4, on which a hob 41 has been mounted.

As shown in FIGS. 1 and 2, the first profile 1 with through holes 11 and an inverted L-shaped section provides a support surface for the counter 4, as well as for the hob 41; and the second profile 2 comprises a solid plate that is exposed on the face of the furniture 3 that is visible, providing an embellishing effect.

As shown by the arrows in FIG. 2, due to the arrangement of the first profile 1 with the through holes 11 thereof and due to the position of the device for reinforcing and ventilating furniture of the invention in the kitchen furniture 3 with a counter 4 and hob 41, air circulates through the same through holes 11, thereby providing proper ventilation.

In different preferred embodiments, the device for reinforcing and ventilating furniture of the proposed invention can have different design and positioning alternatives with respect to the kitchen furniture 3, as well as added features.

Figure 3:
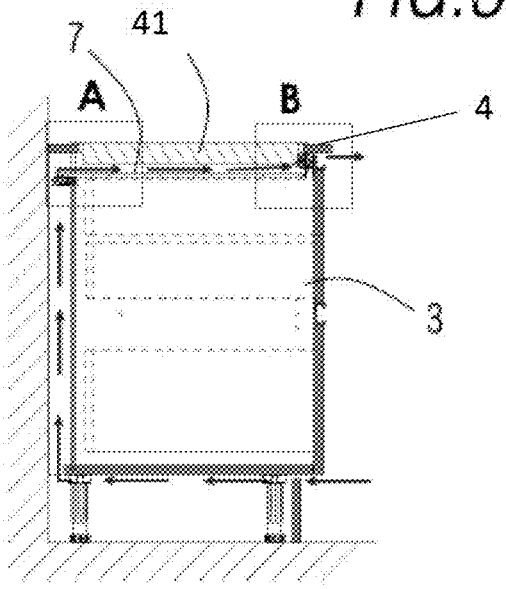
Figure 3:
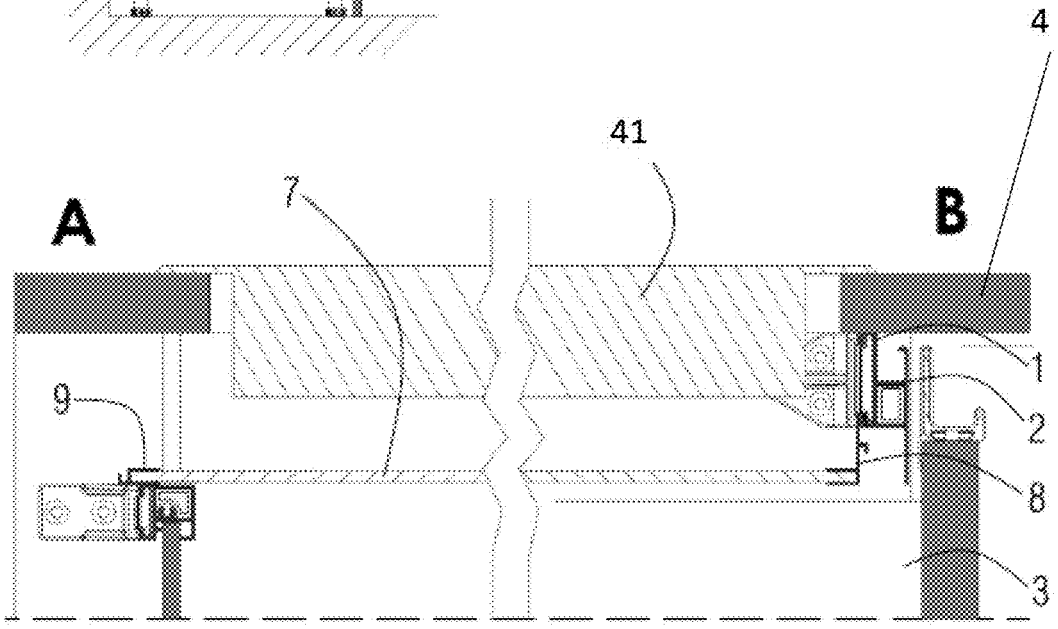
Figure 4:
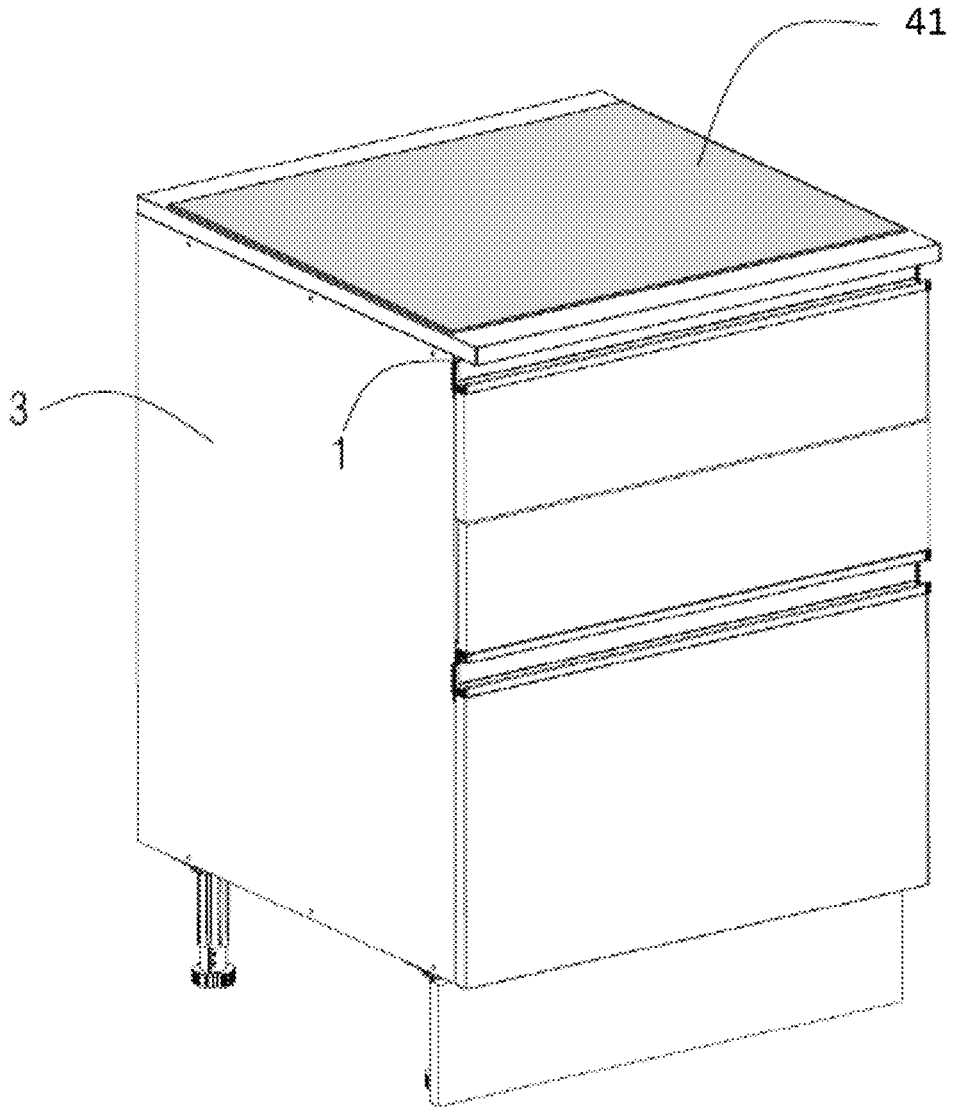

In FIGS. 3 and 4, another arrangement, for example, can be seen for the positioning of the device for reinforcing and ventilating furniture of the invention with respect to kitchen furniture 3, and in a similar fashion to that which is shown in FIG. 2, in which the air circulation is represented by arrows.

Figure 6:
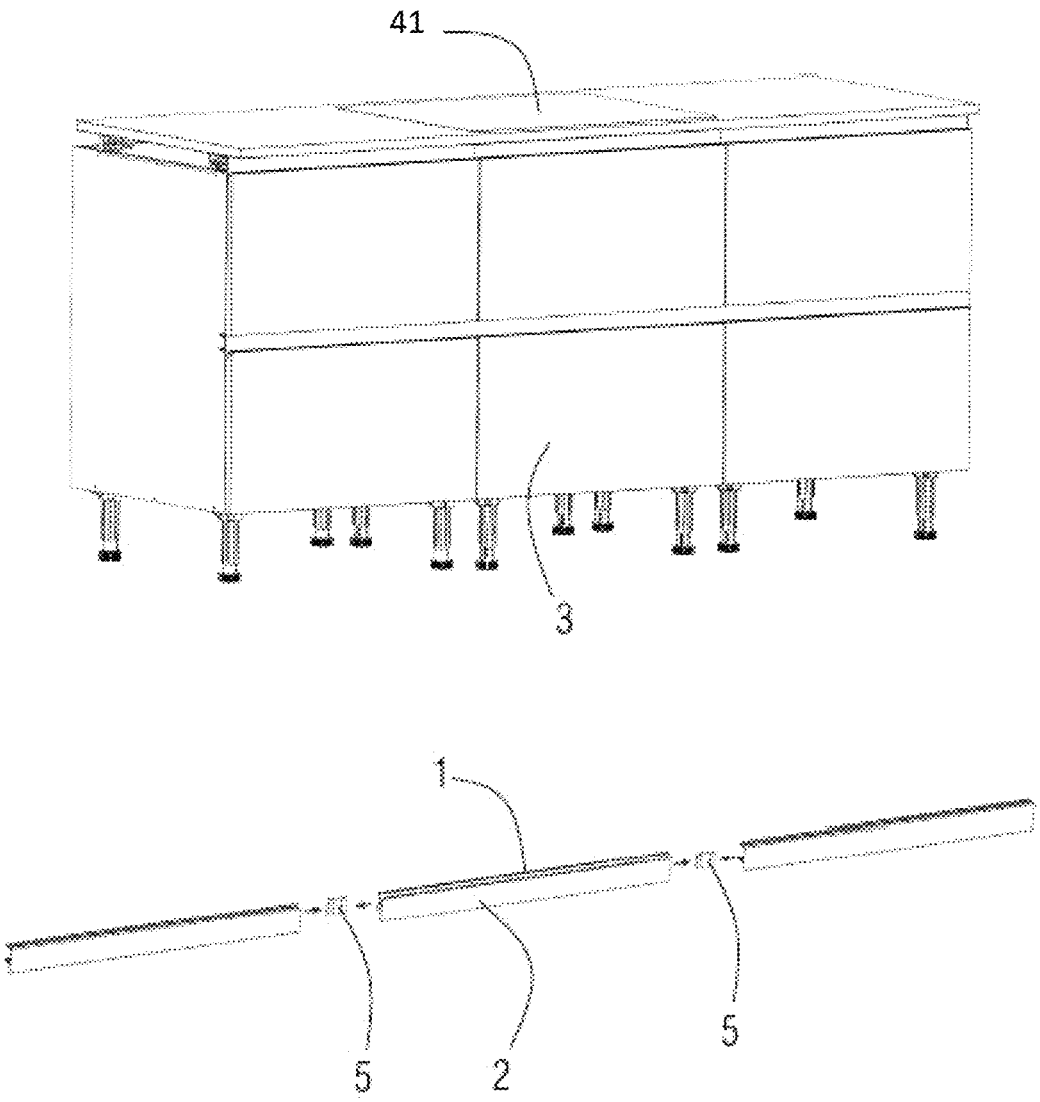
FIG. 6 is a schematic view showing a possibility provided by a preferred embodiment of the device for reinforcing and ventilating furniture of the present invention so that it is additionally arranged in continuity, one next to the other, or mounted in series with other embellishing profiles which are conventionally used in the state of the art, in order to be mounted, for example, on contiguous pieces of furniture.

FIG. 6 schematically shows the possibility also provided by the device for reinforcing and ventilating furniture of the invention so that it is additionally arranged in continuity, one next to the other, in order to be mounted on contiguous pieces of furniture 3 and thereby continue to provide adequate support for the counter 4, which is placed on the surface.

Additionally, the device for reinforcing and ventilating furniture of the present invention can also be mounted in series with other embellishing profiles commonly used in the state of the art.

Figure 5:
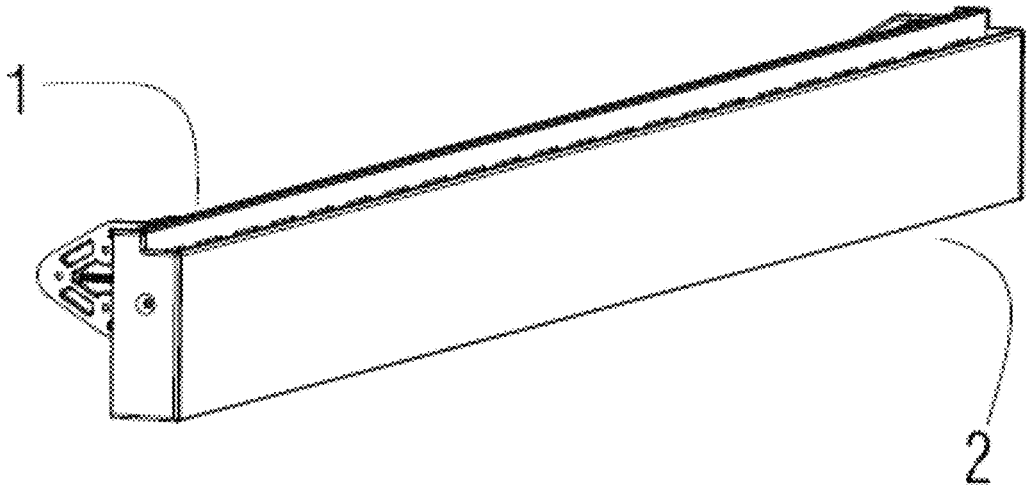
FIG. 5 is a schematic perspective view of another preferred embodiment of the device for reinforcing and ventilating furniture of the present invention.

To do so, the device for reinforcing and ventilating furniture of the invention comprises mounting means enabled for linear mounting of a plurality of first profiles 1 in continuity with the longitudinal dimension thereof, likewise including the second profile 2. In the preferred embodiment shown in FIG. 5, the mounting means comprise screw elements 5.

Figure 7:
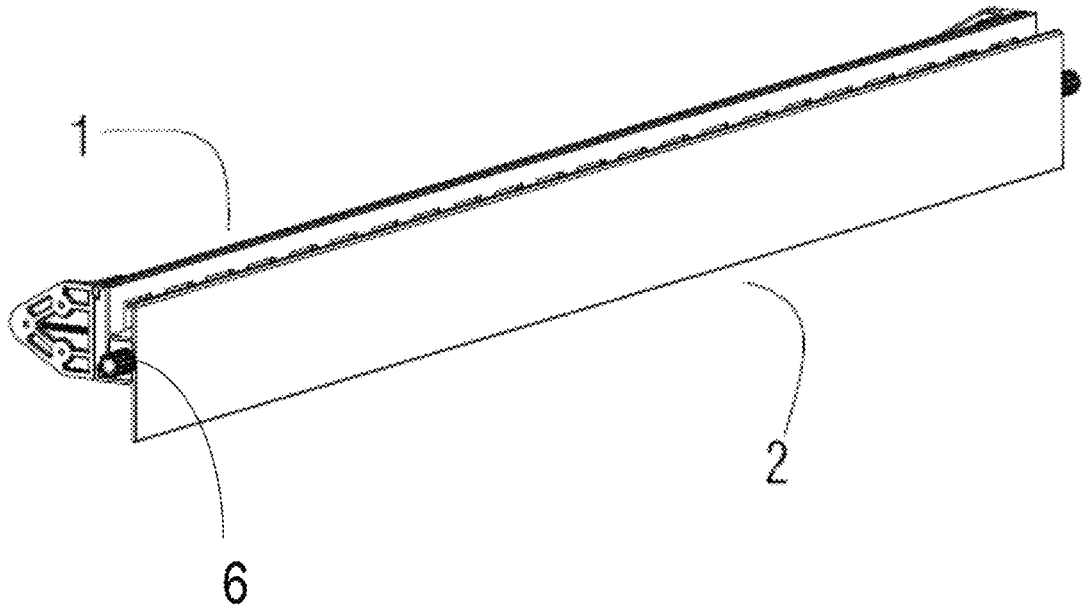
FIG. 7 is a schematic perspective view of another additional embodiment of the device for reinforcing and ventilating furniture of the present invention.

In other preferred embodiments, such as the one represented in FIG. 7, said mounting means can comprise pins 6 able to be inserted by pressure into the ends of the first profile 1, more specifically into the cavity resulting from the joining of the at least first profile 1 with the at least second profile 2.

The device for reinforcing and ventilating furniture of the invention can also be very useful for example in the case of kitchen furniture 3 which includes the counter 4 and an induction hob 41 mounted on the same on the upper surface thereof, and an oven 31 on the bottom portion of the furniture 3.

Therefore, the device for reinforcing and ventilating furniture of the invention incorporates separation means, enabled to be arranged inside the kitchen furniture 3 and to create separated spaces inside the kitchen furniture 3 itself, and thereby separate, for example, the counter 4 and the induction hob 41 mounted on the same on the upper portion of the furniture 3 from the oven 31 mounted on the lower portion of the aforementioned furniture 3.

As can be seen in FIGS. 2 and 3, in this preferred embodiment, the separation means comprise an insulation sheet 7 and a pair of supporting profiles 8 and 9, said pair of profiles enabled to be joined to the first profile 1 along the same longitudinal dimension thereof, or to be supported and sustained in the furniture 3 itself, in the rear portion thereof.

The insulation sheet 7 and the pair of supporting profiles 8 and 9 are mutually enabled so that said insulation sheet 7 is inserted into one of the edges thereof in the profile 8 and the opposite edge in the profile 9, and at the same time it is arranged horizontally and thereby supported inside the furniture 3 itself.

Figure 8:
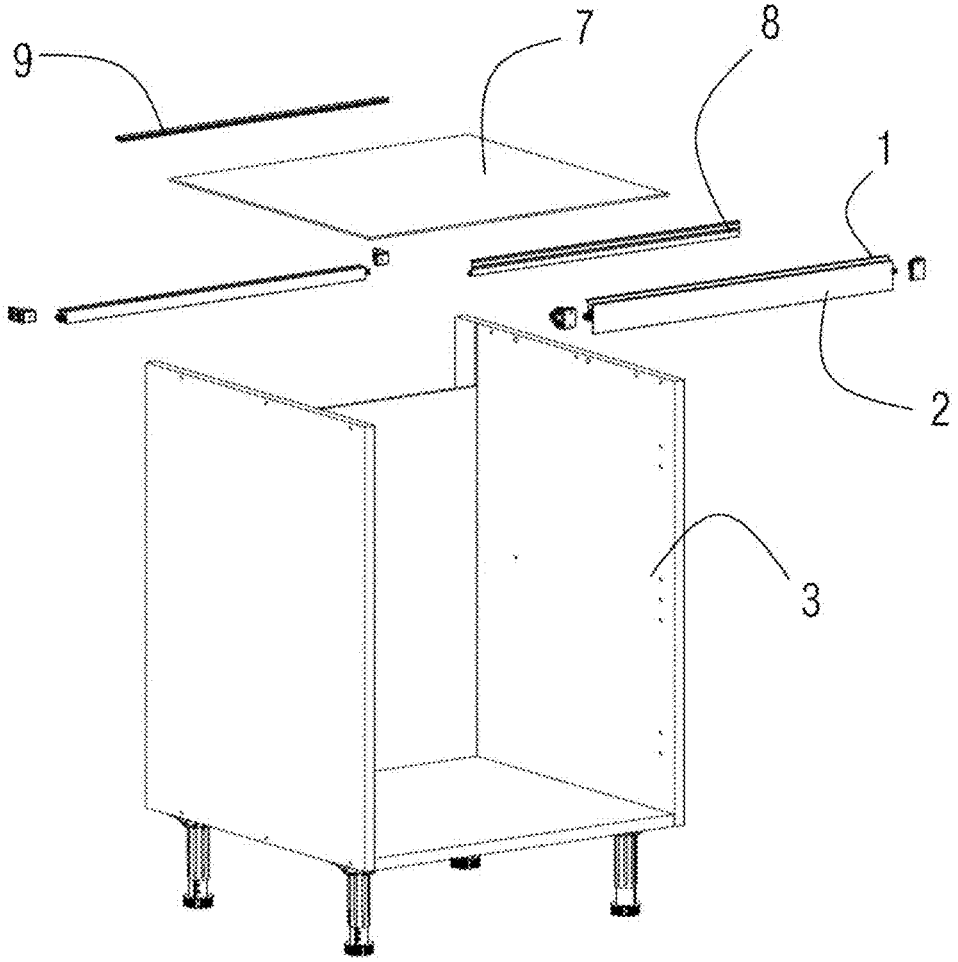
FIG. 8 is a schematic perspective view of the separation means of a preferred embodiment of the device for reinforcing and ventilating furniture of the present invention.

FIG. 8 shows the first profile 1 and the second profile 2, the insulation sheet 7, and the pair of supporting profiles 8 and 9, separate in relation to the furniture 3 itself. Said elements can be supplied as a kit.

The arrangement of said insulation sheet 7 thereby insulates both work areas, since the counter 4, especially when mounted on an induction hob 41, is very sensitive to temperature changes, and as such the heat from the oven 31, when on, could negatively affect the working conditions of the induction hob 41, even causing it to temporarily stop working. Therefore, it is very important to establish these insulation conditions between kitchen elements in order to achieve proper functioning of both, as well as to create a ventilating air current by convection to the area of the induction hob 41, as shown in the figures, which will significantly improve the working conditions of the same.

Figure 9:
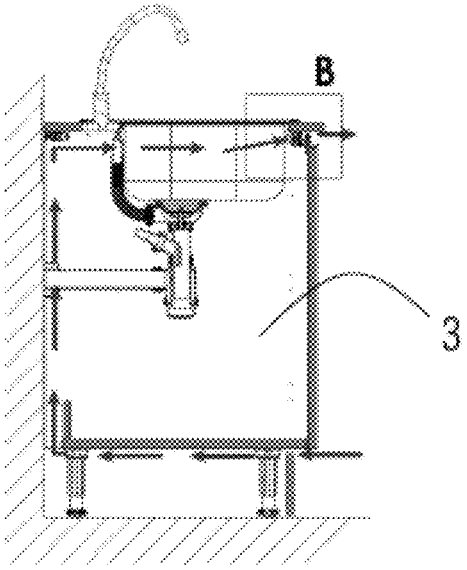
FIGS. 9 and 10 are schematic views showing a preferred embodiment of the device for reinforcing and ventilating furniture of the present invention as used in other kitchen furniture.
Figure 9:
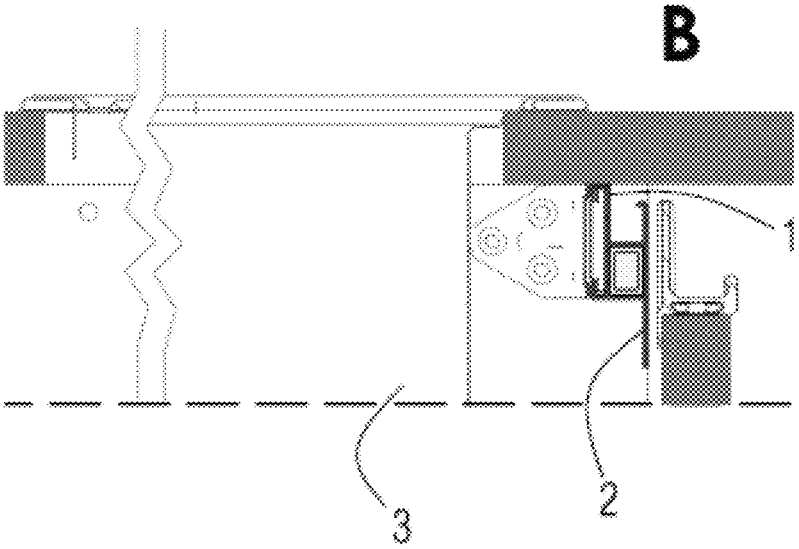
Figure 10:
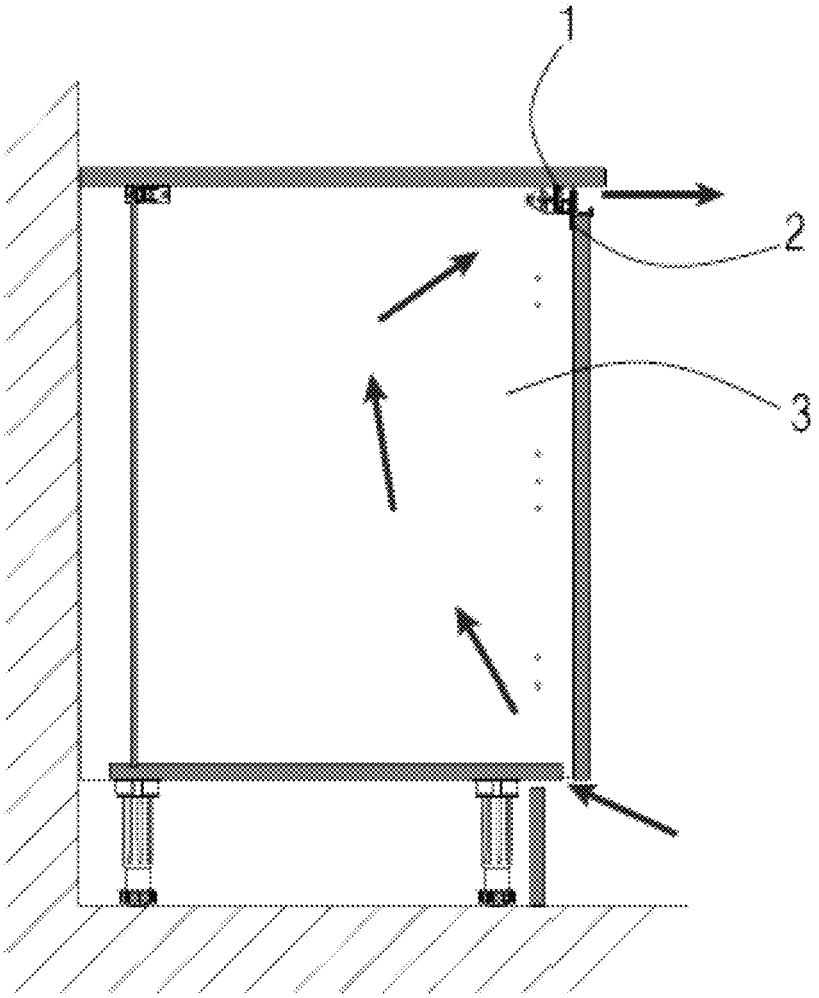

FIGS. 9 and 10 show other arrangement options for the device for reinforcing and ventilating furniture of the invention, adapting to the different types of conditions and requirements of the furniture 3, such as sections of the furniture 3 intended to house water areas (sink, drains, etc.), as well as other sections of the furniture 3 intended to store cleaning products or fresh food, for which it is also convenient and favourable to have interior ventilation of said spaces, and wherein arrows are also used to indicate the air circulation that properly ventilates the same.

Figure 11A:
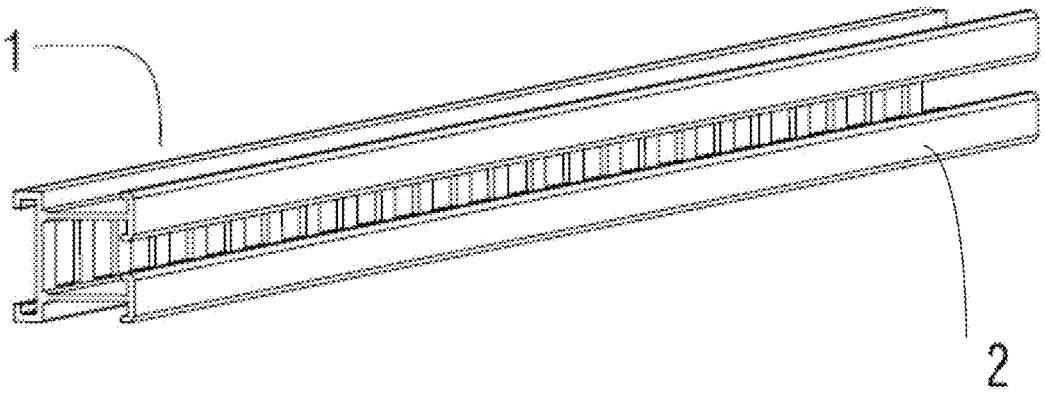
FIGS. 11*a* and 11*b* are schematic views of respective additional embodiments of the device for reinforcing and ventilating furniture of the present invention.
Figure 11B:
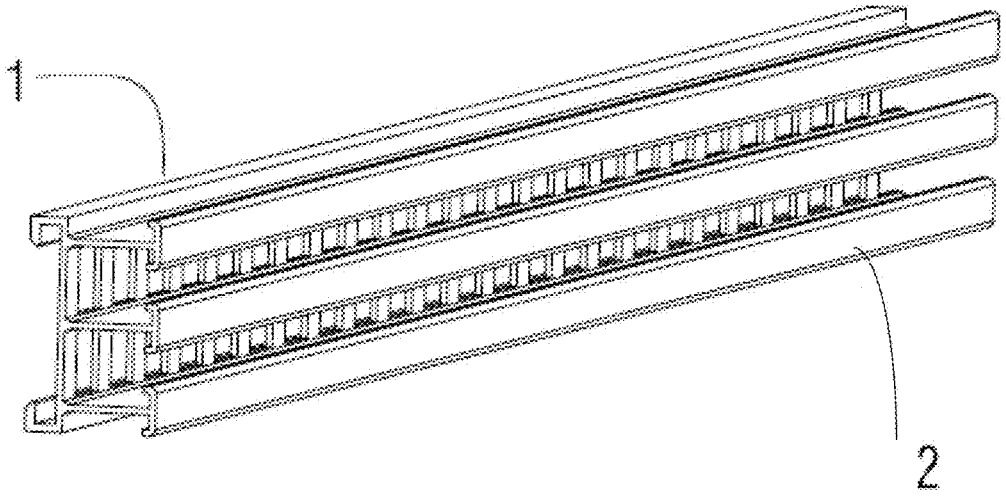

Lastly, FIGS. 11*a* and 11*b* schematically show respective alternative embodiments of the present invention, wherein the device for reinforcing and ventilating furniture of the present invention can be seen with a first profile 1, to which several second profiles 2 are joined, specifically two profiles 2 in the embodiment of FIG. 11*a*, and three profiles 2 in the embodiment of FIG. 11*b*.

The details, shapes, dimensions and other secondary elements, as well as the materials used in manufacturing the device for reinforcing and ventilating furniture of the invention, may be suitably replaced with others that are technically equivalent and do not depart from the essential nature of the invention or from the scope defined by the claims included below.

What is claimed is:

1. A device for reinforcing and ventilating furniture, the device comprising:

at least one first longitudinal profile that has a least one line of through holes arranged along a longitudinal dimension thereof, and at least one second longitudinal profile, the at least first longitudinal profile and the at least second longitudinal profile being mutually joined along the longitudinal dimension thereof and so that the at least first longitudinal profile and the at least second longitudinal profile share their respective longitudinal dimensions; and being the first longitudinal profile enabled to be coupled and fastened to the furniture;

a mounting means enabled for linear mounting of a plurality of the first longitudinal profiles in continuity with the longitudinal dimension thereof, likewise including the second longitudinal profile;

a separation means, enabled to be arranged inside the furniture and to create separated spaces inside the furniture itself, and the separation means comprise an insulation sheet and a pair of supporting profiles, enabled to be joined to the first longitudinal profile along the same longitudinal dimension thereof, as well as to be supported and sustained in the furniture itself, in a rear area thereof;

wherein the insulation sheet and the pair of supporting profiles are mutually enabled so that the insulation sheet is horizontally inserted into edges of each supporting profile of the pair of supporting profiles.

2. The device for reinforcing and ventilating furniture according to claim 1, wherein the first longitudinal profile has an inverted L-shaped section.

3. The device for reinforcing and ventilating furniture according to claim 1, wherein the first longitudinal profile has an inverted C-shaped section.

4. The device for reinforcing and ventilating furniture according to claim 1, wherein the mounting means are enabled for mounting a first longitudinal profile in series and in continuity with the longitudinal dimension thereof, likewise including the second longitudinal profile with other embellishing profiles of a different nature.

5. The device for reinforcing and ventilating furniture according to claim 1, wherein the mounting means comprise screw elements.

6. The device for reinforcing and ventilating furniture according to claim 1, wherein the mounting means comprise pins able to be inserted by pressure into ends of the first longitudinal profile.

7. The device for reinforcing and ventilating furniture according to claim 1, wherein the first longitudinal profile and the second longitudinal profile are integral.

8. The device for reinforcing and ventilating furniture according to claim 1, wherein the first longitudinal profile and the second longitudinal profile are joined by screw elements.

9. The device for reinforcing and ventilating furniture according to claim 1, wherein the first longitudinal profile and the second longitudinal profile are joined by clipping elements.

* * * * *